US006767074B2

(12) United States Patent
Usui et al.

(10) Patent No.: US 6,767,074 B2
(45) Date of Patent: Jul. 27, 2004

(54) SERIAL PRINTING APPARATUS AND PRINTING METHOD

(75) Inventors: Minoru Usui, Nagano (JP); Takahiro Katakura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/760,770

(22) Filed: Jan. 17, 2001

(65) Prior Publication Data

US 2001/0024215 A1 Sep. 27, 2001

Related U.S. Application Data

(63) Continuation of application No. PCT/JP00/03161, filed on May 17, 2000.

(30) Foreign Application Priority Data

May 17, 1999 (JP) ..... H11-135343

(51) Int. Cl.[7] ..... B41J 29/393; B41J 23/00
(52) U.S. Cl. ..... 347/19; 347/37
(58) Field of Search ..... 347/16, 19, 37, 347/20, 40

(56) References Cited

U.S. PATENT DOCUMENTS

| | | | | |
|---|---|---|---|---|
| 5,598,192 A | * | 1/1997 | Burger et al. | 347/43 |
| 5,771,050 A | * | 6/1998 | Gielen | 347/19 |
| 5,870,117 A | | 2/1999 | Moore | |
| 5,880,757 A | | 3/1999 | Ta | |

FOREIGN PATENT DOCUMENTS

| | | | |
|---|---|---|---|
| EP | 0 693 382 A1 | 1/1996 | |
| EP | 0 693 382 | 1/1996 | B41J/29/42 |
| JP | 5-238004 | 9/1993 | B41J/2/01 |
| JP | 6-14375 | 5/1994 | B41J/25/308 |
| JP | 6-143735 | 5/1994 | |
| JP | 8-25703 | 1/1996 | |
| JP | 10-81010 | 3/1998 | H41J/2/01 |

OTHER PUBLICATIONS

International Search Report.
Patent Abstracts of Japan 06–143735.
Patent Abstracts of Japan 05–238004.
EP Search Report dated Jan. 3, 2003 00927791.4–2304–JP0003161.
Japanese Office Action dated Jun. 18, 2003 for Hei. 11–135343.
Communication from EPO for Appln. No. 00 927 791.4–2304 dated Dec. 22, 2003.

* cited by examiner

*Primary Examiner*—Stephen D. Meier
*Assistant Examiner*—Alfred E. Dudding
(74) *Attorney, Agent, or Firm*—Sughrue Mion, PLLC

(57) ABSTRACT

A printing apparatus includes a piezoelectric displacement element 11 for shifting a printing head 6 in a sheet feed direction, in which a recording sheet is fed. The element 11 shifts the head 6 at a predetermined pitch when a new printing pass is performed. Therefore, it is possible to improve the accuracy of printed images without being influenced by the degree of accuracy of a sheet feed mechanism.

9 Claims, 6 Drawing Sheets

| SET OF LINES | I | II | III | IV | V | VI | VII |
|---|---|---|---|---|---|---|---|
| DISTANCE BETWEEN THE ADJACENT SETS | 1 | -1 | -4 | 10 | 4 | 4 | 10 |
| | | | | | | | |
| | | | | | | | |
| | (3) | | | | | | |
| | | (1) | | | | | |
| | | | | | | | |
| | (3) | | | | | | |
| | | (3) | | | | | |
| | | | (1) | | | | |
| | (4) | | | | | | |
| | | (3) | | | | | |
| | | | (2) | | | | |
| | (5) | | | | | | |
| | | (1) | | | | | |
| | | | (3) | | | | |
| | (6) | | | | | | |
| | | (5) | | | | | |
| | | | (4) | | | | |
| | | | | (1) | | | |
| | | (6) | | | | | |
| | | | (5) | | | | |
| | | | | (3) | | | |
| | | | | | (1) | | |
| | | | (6) | | | | |
| | | | | (3) | | | |
| | | | | | (3) | | |
| | | | | | | (1) | |
| | | | | (4) | | | |
| | | | | | (3) | | |
| | | | | | | (2) | |
| | | | | (5) | | | |
| | | | | | (4) | | |
| | | | | | | (3) | |
| | | | | (6) | | | |
| | | | | | (5) | | |
| | | | | | | (4) | |
| | | | | | | | (1) |
| | | | | | (6) | | |
| | | | | | | (5) | |
| | | | | | | | (2) |
| | | | | | | | |
| | | | | | | (6) | |
| | | | | | | | (3) |
| | | | | | | | |
| | | | | | | | |
| | | | | | | | (4) |
| | | | | | | | |
| | | | | | | | |
| | | | | | | | (5) |
| | | | | | | | |
| | | | | | | | |
| | | | | | | | (6) |

FIG. 7

SERIAL PRINTING APPARATUS AND PRINTING METHOD

This is a continuation of Application No. PCT/JP00/03161 filed May 17, 2000, the disclosure of which is incorporated herein by reference.

BACKGROUND OF THE INVENTION

The present invention relates to a serial printing apparatus. The apparatus includes a sheet feed mechanism, which feeds a recording sheet at a predetermined pitch, and a printing head, which is mounted on a reciprocating carriage to form dots on the sheet.

A serial printing apparatus, such as an ink jet printing apparatus for color printing, has a carriage on which an ink jet printing head is mounted. The head has plural nozzle arrays, usually, four or more nozzle arrays, that eject differently colored ink droplets. The head moves in a main scanning direction and ejects the ink droplets on a recording sheet in response to printing data. When one scanned image is printed, a sheet feed mechanism feeds the recording sheet at a predetermined pitch. The apparatus alternately prints one scanned image and feeds the sheet.

Since the nozzle-pitch is extremely small, due to production improvements, the head prints at a resolution of 1440 dpi or higher. Moving the carriage continuously improves the accuracy of the printing position and the printing density in the main scanning direction. However, since the sheet feed mechanism intermittently drives in the sub-scanning direction, it is difficult to improve the positioning accuracy because of backlash.

The sheet feed mechanism has a sheet feed roller. The roller includes a driving shaft, which is connected with a driving motor through a transmitting means such as a set of gears, and a nonskid, elastic material made from rubber for covering the shaft. The backlash caused by the transmitting means and eccentricity of the roller decreases the accuracy of feeding sheets.

In order to solve these problems, a method for printing in which a sheet is continuously moved has been proposed. However, in this method the sub-scanning direction is inclined relative to the main scanning direction. Therefore, the sheet must be trimmed after printing. Also, the relative inclination of the scanning directions complicates the carriage moving mechanism.

Accordingly, it is an object of the present invention to provide a serial printing apparatus that improves printing accuracy in the sub-scanning direction without complicating the carriage moving mechanism and the sheet feed mechanism.

SUMMARY OF THE INVENTION

The present invention provides a printing apparatus that includes a printing head, a sheet feed mechanism and a displacement mechanism. The printing head reciprocates along an axis for performing printing passes. The sheet feed mechanism incrementally feeds a sheet in a direction transverse to the axis. The distance of each increment of sheet feeding is predetermined. The displacement mechanism shifts the printing head relative to the sheet in the sheet feeding direction or in a direction opposite to the sheet feeding direction to prepare for a printing pass. The distance by which the printing head is shifted to prepare for a printing pass is less than the distance of each increment of sheet movement. The displacement mechanism shifts the printing head between instances of sheet feeding.

The sheet feed mechanism feeds the sheet by the predetermined distance at which the mechanism can accurately feed. The displacement mechanism shifts the head relative to the sheet by the distance at which the feed mechanism cannot accurately feed. Accordingly, the apparatus finely prints with an accuracy.

BRIEF DESCRIPTION OF THE DRAWINGS

FIGS. 5, 6 and 7 are views showing how the apparatus prints.

DETAILED DESCRIPTION OF THE PREFERRED ENBODIMENTS

Details of the present invention are explained according to illustrated embodiments as follows.

Figure 1:
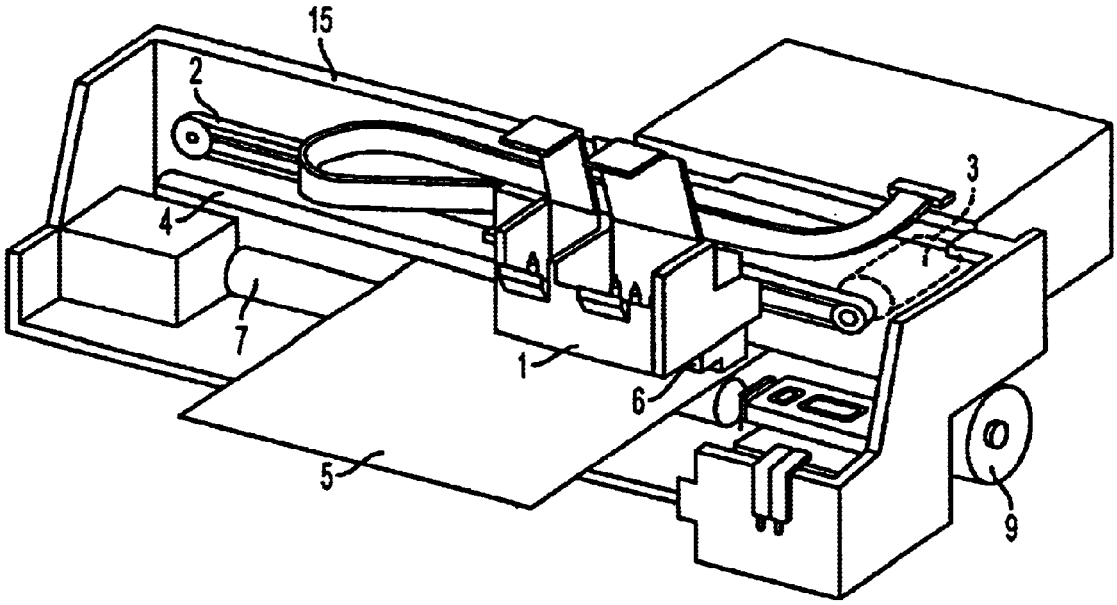
FIG. 1 illustrates an embodiment of a serial printing apparatus of the present invention.
Figure 2:
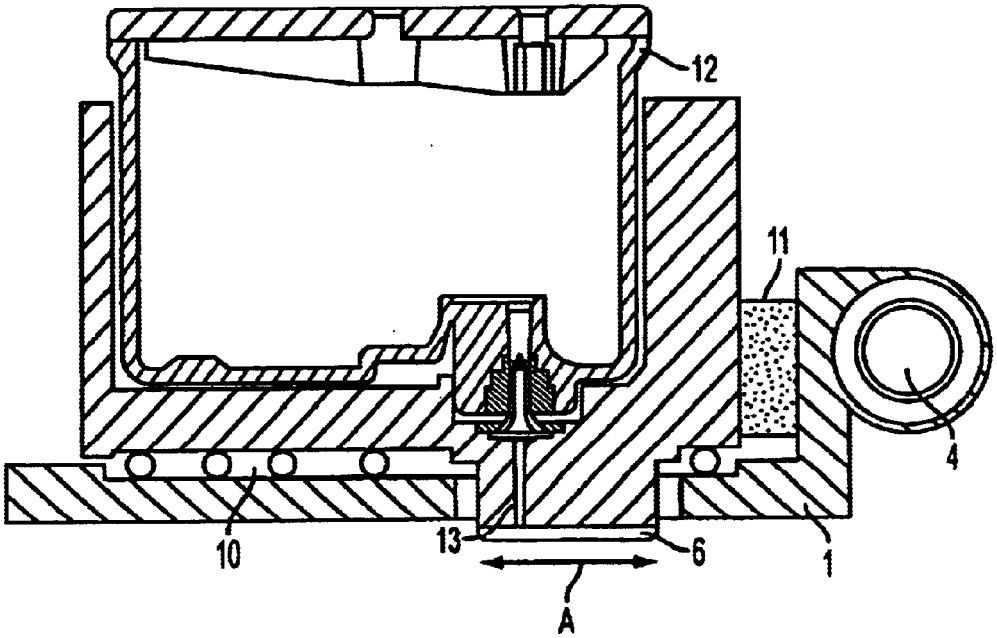
FIG. 2 is a cross sectional view showing the structure in the vicinity of a carriage of the apparatus.
Figure 3:
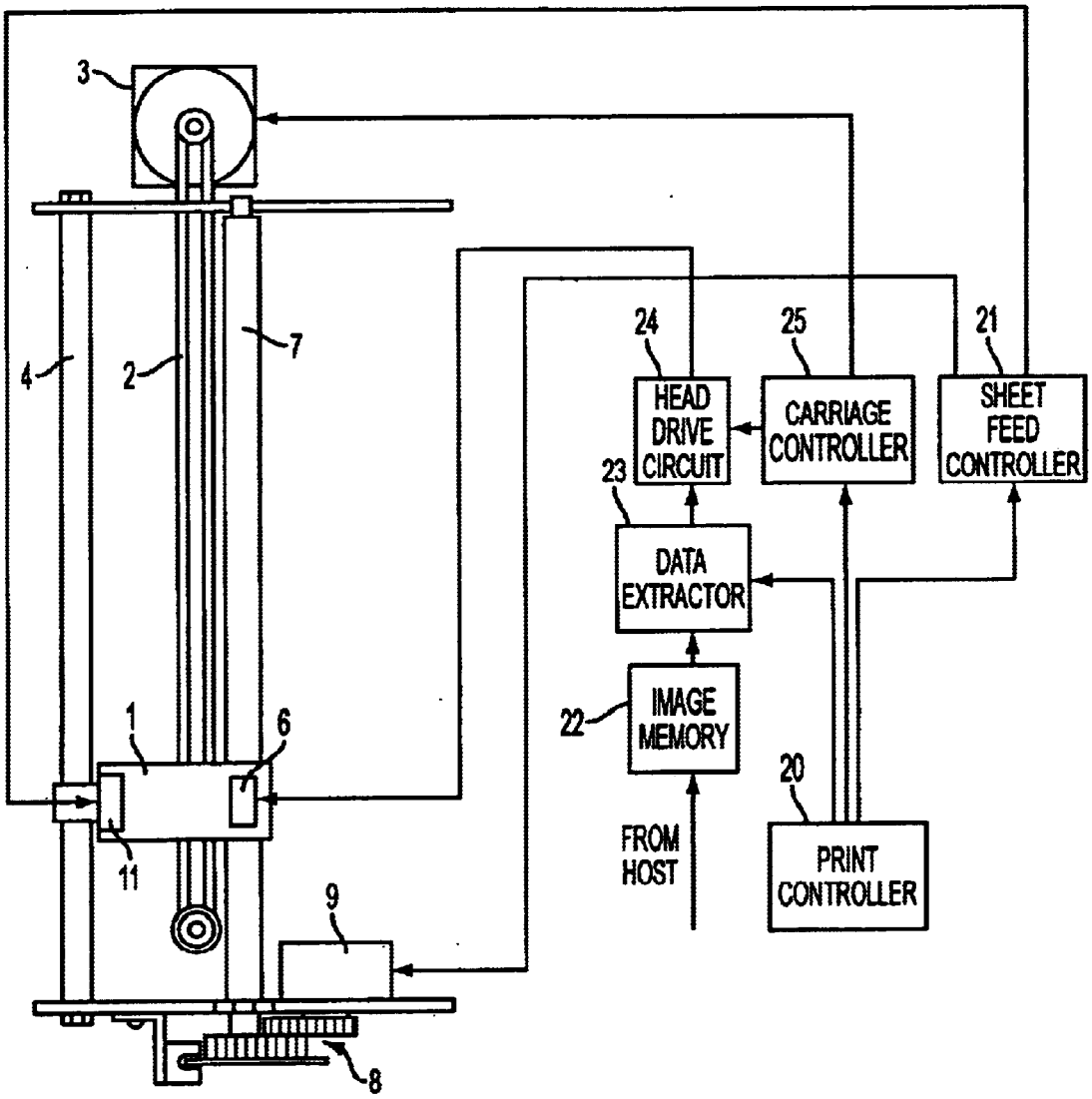
FIG. 3 is a block diagram showing an embodiment of the apparatus.

FIGS. 1 to 3 illustrate an embodiment of a serial printing apparatus of the present invention. A carriage 1 connects with a drive motor 3 through a transmitting mechanism 2 and reciprocates along a guide rod 4 in the width direction of a recording sheet 5, or in a main scanning direction. A printing head 6 is attached to the carriage 1. A sheet feed roller 7 connects with a sheet feed motor 9 through gears 8 and incrementally feeds the sheet 5 in a sub scanning direction by a predetermined distance.

FIG. 2 shows an embodiment of the carriage 1. The head 6 is attached to the carriage 1 through a guide mechanism 10 and is permitted to move along the sheet feed direction (as shown by the arrow A). One end of the head 6 is fixed to the carriage 1 through a piezoelectric displacement element 11. Reference numeral 12 shows an ink cartridge, which provides the head 6 with ink through ink induction paths 13 (only one is shown in FIG. 2). The element 11 includes plural-laminated electrodes and piezoelectric materials, so that large displacements are precisely controlled by electric signals.

The displacement is computed by the following formula: the number of laminated layers×displacement constant× voltage applied to each element. When low voltage such as 29.4 V is applied to a laminated piezoelectric element that has one thousand laminated layers and the displacement constant of $600\times e^{-12}$, a displacement of 17.6 $\mu$m (1/1440 inch) is obtained.

Figure 4:
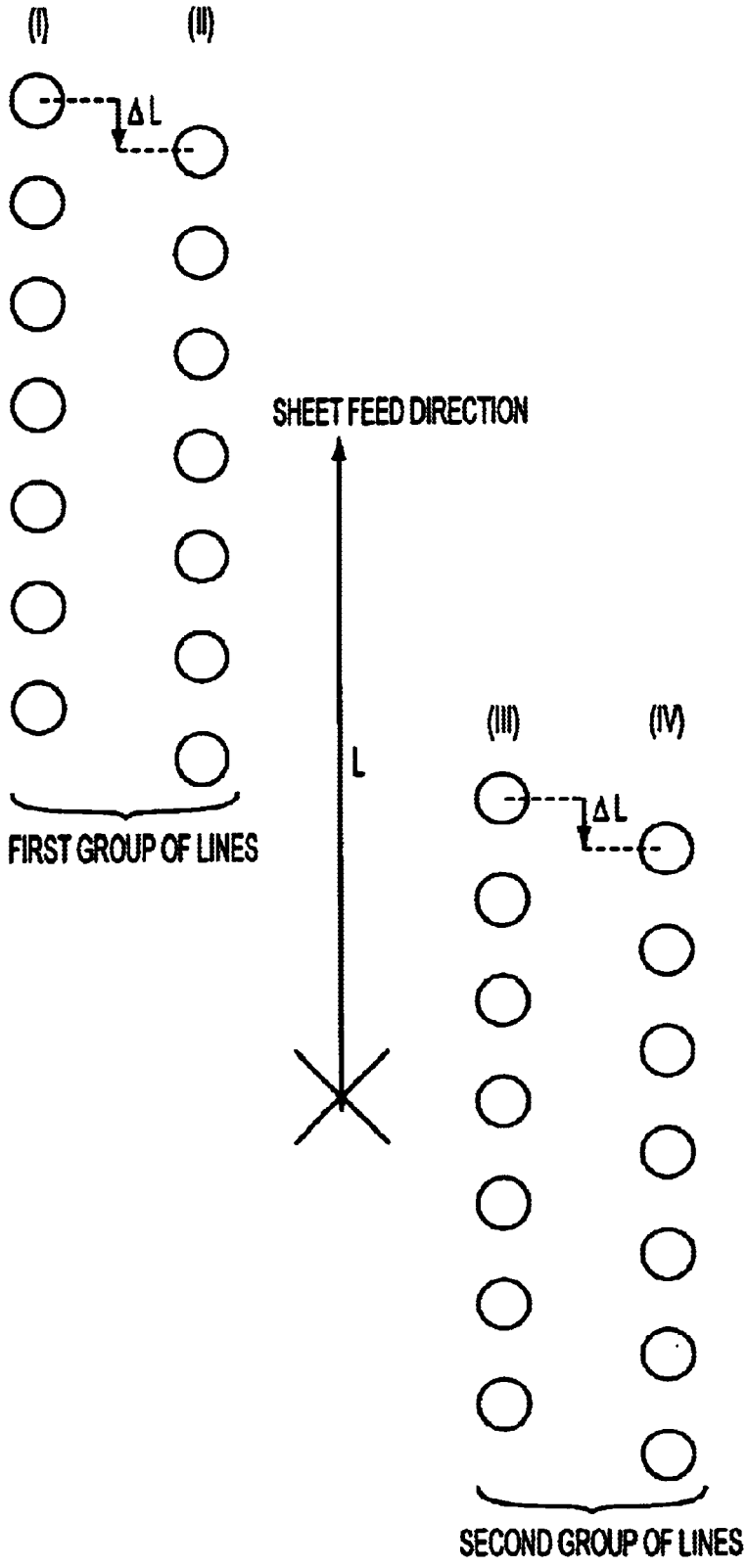
FIG. 4 is a diagram showing a sheet feed operation.

FIG. 3 is a block diagram showing one embodiment of the present invention. A print controller 20 drives the motor 9 through a sheet feed controller 21 and feeds the sheet 5 by one group of printing lines (FIG. 4). The print controller 20 causes an extractor 23 to extract data of odd-numbered lines in one group of printing lines from bit map data of an image memory 22 and to output the data to a head driver 24. The print controller 20 causes a carriage controller 25 to move the carriage 1 in the main scanning direction, and the data of the odd-numbered lines, or the first set of lines, is printed (see column I in FIG. 4).

After printing the odd-numbered lines in one group of printing lines, or after one printing pass, the sheet feed controller 21 activates the element 11 to move the head 6 by a distance that corresponds to one line, or $\Delta L$, in a direction opposite to the sheet feed direction. At the same time, the extractor 23 extracts data of the even-numbered lines in one group of printing lines from the bit map data of the image memory 22 and outputs the data to the head driver 24. The carriage controller 25 moves the carriage 1 in the main scanning direction and prints the even-numbered lines, or the second set of lines. Thus, the even-numbered lines are printed between the printed odd-numbered lines, which completes printing of the first group of lines (see column II in FIG. 4).

After printing the first group of lines, the print controller 20 causes the motor 9 to feed the sheet 5 by one group of lines, or L. The print controller 20 de-energizes the element 11 and returns the head 6 to a reference position of the carriage 1. As a result, the head 6 is set at a reference position to print the odd-numbered lines in the second group of lines.

The extractor 23 extracts data of the odd-numbered lines, or the third set of lines, from bit map data of the image memory 22 and prints the odd-numbered lines (see column III in FIG. 4). Then, after the element 11 displaces the head 6 by one line, or ΔL, the even-numbered lines in the second group of lines, or the lines of the fourth set, are printed (see column IV in FIG. 4).

A sheet feed mechanism having the sheet feed roller 6, the gears 8 and the feed motor 9 feeds the sheet 5 by a distance at which the mechanism can accurately feed the sheet 5. Moving the head 6 by the element 11 provides slight relative movement between the sheet 5 and the head 6 by a distance at which the mechanism cannot accurately feed.

Figure 5:
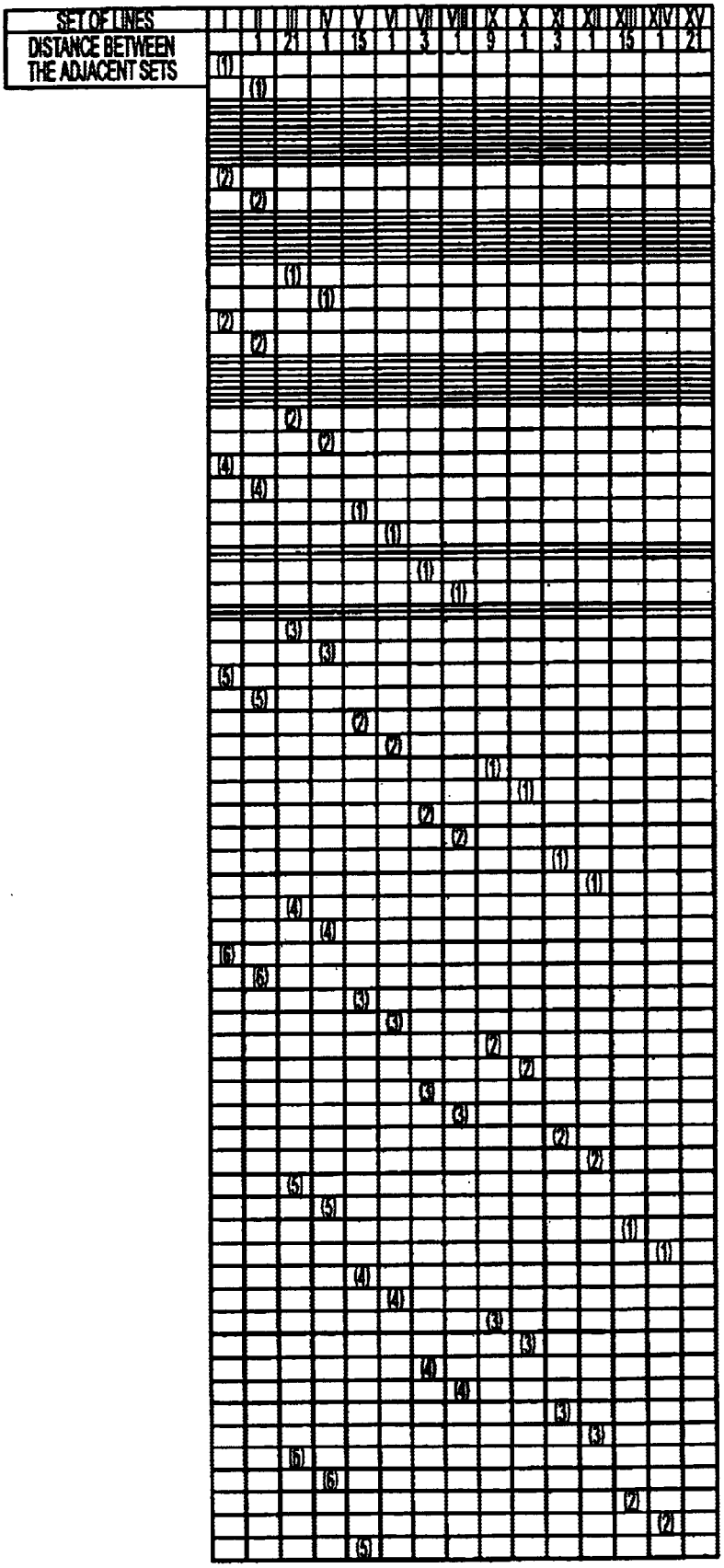

FIG. 5 illustrates how a serial printing apparatus of the present embodiment prints. Reference numerals ① to ⑥ represent nozzles. The number of the nozzle is six, and the nozzle pitch corresponds to twelve lines.

When printing the first set of lines (see column I in FIG. 5), the head 6 forms dots with a twelve-dot space between each adjacent pair of lines. As described above, after the element 11 moves the head 6 by a distance that corresponds to one line and one set of lines is printed, the second set of lines is printed next to the first set of lines (see column II in FIG. 5).

After printing the second set of lines, the motor 9 moves the sheet 5 by a distance that corresponds to twenty-two lines. The element 11 is de-energized, and the head 6 returns to the initial position relative to the carriage 1. Under this condition, the third set of lines is printed (see column III in FIG. 5). The printed third set of lines is displaced from the printed second set of lines by a distance that corresponds to twenty-one lines.

Next, the element 11 is activated so that the head 6 is shifted by a distance that corresponds to one line. Then, the fourth set of lines is printed (see column IV in FIG. 5). Before printing each set of lines, the sheet 5 and the head 6 are fed or shifted as follows. Before printing the fifth, seventh, ninth and eleventh sets of lines, the motor 9 feeds the sheet 5 by distances that correspond to sixteen, four, ten and four lines (see columns V, VII, IX and XI in FIG. 5). Before printing the sixth, eighth, tenth and twelfth sets of lines, the element 11 shifts the head 6 by a distance that corresponds to one line (see columns VI, VIII, X and XII in FIG. 5).

In this way, the element 11 shifts the head 6 by a distance that corresponds to one line. The motor 9 feeds the sheet 5 by distances that correspond to four, ten, sixteen and twenty-two lines. After an image is printed in twelve sets of lines, lines fill the space defined by the nozzle pitch.

Accordingly, when the above printing procedure is repeated, dots are densely formed on the sheet 5.

Figure 6:
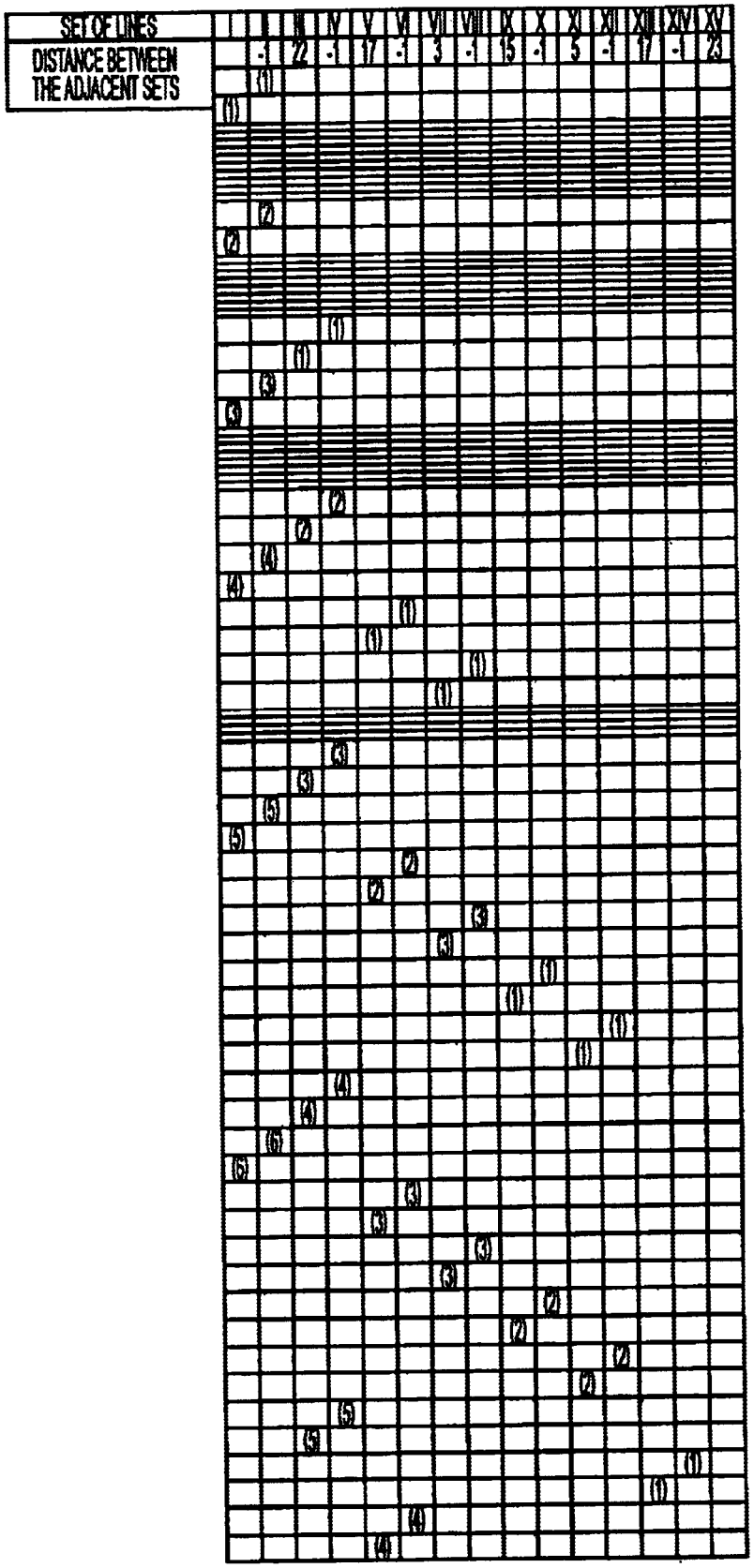

The above describes printing when the head 6 is shifted in a direction opposite to the sheet feeding direction. However, as shown in FIG. 6, the displacement direction of the element 11 may be reversed. Namely, when the element 11 is activated, the head 6 may be displaced by a distance that corresponds to one line in the sheet feed direction. In this case, after printing the first set of lines (see column I in FIG. 6), the element 11 is activated and the head 6 is shifted by a distance that corresponds to one line in the sheet feed direction. In this condition, the second set of lines is printed (see column II in FIG. 6).

After the sheet 5 is fed by the motor 9 by a distance that corresponds to twenty-two lines and the head 6 returns to the initial position, the third set of lines is printed (see column III in FIG. 6). The printed third set of lines is displaced from the printed second set of lines by a distance that corresponds to twenty-three lines.

Then, the element 11 is activated so that the head 6 is shifted by a distance that corresponds to one line in the sheet feed direction, and the forth set of lines is printed (see column IV in FIG. 6). After that, the sheet 5 is fed by distances that correspond to sixteen, two, fourteen and two (see columns V, VII, IX and XI in FIG. 6). When printing after feeding the sheet 5 by the motor 9, the element 11 shifts the head 6 by a distance that corresponds to one line in the sheet feed direction (see columns VI, VIII, X and XII in FIG. 6). As a result, lines are printed to fill the space defined by the nozzle pitch.

Accordingly, when printing the above twelve set of lines repeatedly, dots are densely formed within a printing area on the sheet 5.

In these embodiments, the element 11 displaces the head 6 by a distance that corresponds to one line. However, a head 6 may have six nozzles and a three-dot nozzle pitch, and the element 11 may be displaced by a distance that corresponds to eight lines.

In such a construction, as shown in FIG. 7, the element 11 shifts the head 6 by a distance that corresponds to four lines before printing the second set of lines (see column II in FIG. 7). After that, the element 11 shifts the head 6 by a distance that corresponds to four lines for printing the third set of lines (see column III in FIG. 7).

Then, the operation of the element 11 is halted, and the head 6 returns to the initial position. The motor 9 feeds the sheet 5 by a distance that corresponds to eighteen lines, and the fourth set of lines is printed (see column IV in FIG. 7). The printed fourth set of lines is displaced from the printed third set of lines by a distance that corresponds to ten lines. The element 11 shifts the head 6 by a distance that corresponds to four lines, and the fifth set of lines is printed (see column V in FIG. 7). The element 11 shifts the head 6 by a distance that corresponds to four lines, and the head 6 prints the sixth set of lines (see column VI in FIG. 7).

The above procedure for printing seven sets of lines is repeated. Accordingly, the element 11 shifts the head 6 by a distance that corresponds to a plurality of lines so that the head 6 prints in a printing area to fill the space defined by the nozzle pitch.

In the above embodiments, the element 11, which is provided between the carriage 1 and the head 6, shifts the head 6 relative to the carriage 1. However, providing a piezoelectric displacement element between the guide rod 4 and a frame 15 and moving the whole carriage 1 has the same effect.

In the above embodiments, the head 6 is shifted by a distance that corresponds to one or more lines. The amount of displacement is arbitrarily controlled by adjusting the voltage of a drive signals applied to the element 11. Therefore, the head 6 is shifted by a distance that corresponds to 1/n of a line pitch (n is an integer of two or more). The moving error in the sheet feeding direction caused by the sheet feed mechanism may be detected by a sheet movement detector. The error may be corrected by referring to corrective data, which is obtained by measurement of the relationship between the rotating angle of the sheet feed roller and the amount of sheet feeding.

As a mover for moving the head 6, it is possible to use not only a laminated piezoelectric vibrator, but also a bimorph-piezoelectric displacement element and several types of actuators that have a driving force for controlling and moving the head 6 by an electric signal. These actuators include a static actuator, an electromagnetic actuator, a light displacement actuator and an actuator to which a shape memory-alloy is applied.

In the above embodiments, a printing apparatus, which forms dots by ink droplets, is described. However, the invention may be applied to a sheet feed mechanism for other printing heads, such as in a thermal transfer printing method or a sublimation printing method, with the same effect.

In the above embodiments, the head is shifted parallel to a plane parallel to the sheet feed direction. However, rotating a printing head around its scanning shaft has the same effect. In this case, when the distance between the head and a recording sheet is 1 mm and the angle between them is changed by one degree, ink droplets, which form dots, are shifted approximately by 1/1440 inch.

The present invention provides a sheet feed mechanism, which feeds a recording sheet at a predetermined pitch, and a printing head, which is mounted on a reciprocating carriage to form dots on the sheet. The serial printing apparatus has a displacement element, which displaces the head along a sheet feed direction relative to the carriage. The displacement mechanism shifts the head when a new printing pass is performed. Accordingly, the feed mechanism feeds the sheet by the predetermined distance at which the mechanism can accurately feed. The displacement mechanism, which displaces with a high accuracy, shifts the head 6 by one set of lines, which is a distance by which the feed mechanism cannot accurately feed a sheet. Therefore, printed images is improved without complicating the feed mechanism. In particular, the printing quality of image data that is influenced by the degree of positioning accuracy of the dots is improved.

What is claimed is:

1. A serial printing apparatus having a sheet feed mechanism and a printing head, wherein the mechanism feeds a recording sheet at a predetermined pitch and the printing head is mounted on a carriage to form dots on the sheet, and wherein the carriage reciprocates along a guide means, the serial printing apparatus comprising a displacement mechanism for shifting the printing head relative to the carriage, wherein the displacement mechanism shifts the printing head at a predetermined pitch in response to a switching of a printing pass;

wherein the displacement mechanism is disposed between the printing head and the carriage;

wherein the displacement mechanism directly abuts the printing head and the carriage; and, wherein the feed mechanism feeds the sheet by a distance that corresponds to a plurality of dots that are formed by the printing head, and wherein the displacement mechanism shifts the printing head by a distance that is less than the pitch of one dot that is formed by the printing head.

2. A serial printing apparatus having a sheet feed mechanism and a printing head, wherein the mechanism feeds a recording sheet at a predetermined pitch and the printing head is mounted on a carriage to form dots on the sheet, and wherein the carriage reciprocates along a guide means, the serial printing apparatus comprising a displacement mechanism for shifting the printing head relative to the carriage, wherein the displacement mechanism shifts the printing head at a predetermined pitch in response to a switching of a printing pass;

wherein the displacement mechanism is disposed between the printing head and the carriage;

wherein the displacement mechanism directly abuts the printing head and the carriage; and wherein the feed mechanism feeds the sheet by a distance that corresponds to a plurality of dots, which are formed by the printing head, and the displacement mechanism shifts the printing head by a distance that is less than the feed mechanism feeds.

3. The serial printing apparatus according to claim 2, wherein, after printing in response to feeding by the feed mechanism, the printing head is shifted by the displacement mechanism in a direction opposite to the sheet feed direction and prints.

4. The serial printing apparatus according to claim 2, wherein a plurality of lines are printed continuously after the displacement mechanism shifts the printing head.

5. The serial printing apparatus according to any one of claims 1, 3 or 4 wherein the displacement mechanism includes a piezoelectric displacement element.

6. A serial printing apparatus having a sheet feed mechanism and a printing head, wherein the mechanism feeds a recording sheet at a predetermined pitch and the printing head is mounted on a carriage to form dots on the sheet, and wherein the carriage reciprocates along a guide means, the serial printing apparatus comprising a displacement mechanism for shifting the printing head relative to the carriage, wherein the displacement mechanism shifts the printing head at a predetermined pitch in response to a switching of a printing pass;

wherein the displacement mechanism is disposed between the printing head and the carriage;

wherein the displacement mechanism directly abuts the printing head and the carriage; and wherein the displacement mechanism includes a piezoelectric displacement element.

7. A serial printing apparatus having a sheet feed mechanism and a printing head, wherein the feed mechanism feeds the sheet at a predetermined pitch and the printing head is mounted on a carriage to form dots on the sheet, and wherein the carriage reciprocates along a guide means, and wherein odd-numbered lines or even-numbered lines in one set of lines are printed after the feed mechanism feeds the sheet at a predetermined pitch, and wherein the remainder of the odd-numbered lines or the even-numbered lines are printed after a displacement mechanism shifts the printing head by one set of lines; and wherein the displacement mechanism is disposed between the printing head and the carriage;

wherein the displacement mechanism directly abuts the printing head and the carriage; and wherein the feed mechanism feeds the sheet by a distance that corresponds to a plurality of dots, which are formed by the printing head, and the displacement mechanism shifts the printing head by a distance that is less than the feed mechanism feeds.

8. A serial printing apparatus having a sheet feed mechanism and a printing head, wherein the feed mechanism feeds the sheet at a predetermined pitch and the printing head is mounted on a carriage to form dots on the sheet, and wherein the carriage reciprocates along a guide means, and wherein odd-numbered lines or even-numbered lines in one set of lines are printed after the feed mechanism feeds the sheet at a predetermined pitch, and wherein the remainder of the odd-numbered lines or the even-numbered lines are printed after a displacement mechanism shifts the printing head by one set of lines; and wherein the displacement element is disposed between the printing head and the carriage;

wherein the displacement mechanism directly abuts the printing head and the carriage; and wherein the displacement mechanism includes a piezoelectric displacement element.

9. A serial printing apparatus having a sheet feed mechanism and a printing head, wherein the feed mechanism feeds a recording sheet at a predetermined pitch and the head is mounted on a carriage to form dots on the sheet, and wherein the carriage reciprocates along a guide means, the serial printing apparatus comprising a displacement mechanism for shifting the head relative to the carriage, wherein the displacement mechanism shifts the head at a predetermined pitch in response to a switching of a printing pass;

wherein the displacement mechanism is disposed between the printing head and the carriage;

wherein the displacement mechanism directly abuts the printing head and the carriage; and wherein the printing head is shifted in a sub-scanning direction; and wherein the feed mechanism feeds the sheet by a distance that corresponds to a plurality of dots, which are formed by the printing head, and the displacement mechanism shifts the printing head by a distance that is less than the feed mechanism feeds.

* * * * *